United States Patent [19]

Engel et al.

[11] 3,995,557

[45] Dec. 7, 1976

[54] BASE FUZE FOR A SPINNING PROJECTILE

[75] Inventors: Walter Engel, Dubendorf; Paul Cahannes, Zurich, both of Switzerland

[73] Assignee: Werkzeugmaschinenfabrik Oerlikon-Buhrle AG, Zurich, Switzerland

[22] Filed: Nov. 13, 1975

[21] Appl. No.: 631,672

[30] Foreign Application Priority Data

Nov. 20, 1974 Switzerland ..... 15428/74

[52] U.S. Cl. ..... 102/79; 102/73 A

[51] Int. Cl.[2] ..... F42C 15/22

[58] Field of Search ..... 102/73, 73 A, 70 R, 102/79, 78, 80

[56] References Cited

UNITED STATES PATENTS

| | | | |
|---|---|---|---|
| 2,513,536 | 7/1950 | Wellington | 102/73 A |
| 2,598,157 | 5/1952 | Everett | 102/79 |
| 3,033,115 | 5/1952 | Guerne | 102/79 X |
| 3,270,670 | 9/1966 | Guerne | 102/79 |
| 3,479,955 | 11/1969 | Birkigt | 102/79 X |
| 3,585,935 | 6/1971 | Birkigt | 102/79 |

*Primary Examiner*—David H. Brown
*Attorney, Agent, or Firm*—Werner W. Kleeman

[57] ABSTRACT

A base fuze for a spinning projectile comprising a firing pin for piercing a detonator cap, a hammer sleeve secured to the firing pin, a self-destruction spring by means of which the hammer sleeve together with the firing pin can be displaced towards the detonator cap. An inertia body is provided for increasing the response sensitivity and is located behind the hammer sleeve. Upon impact of the projectile the inertia body bears directly at the hammer sleeve in order to increase the mass of the hammer sleeve when piercing the detonator cap by means of the firing pin due to the inertia of such inertia body.

5 Claims, 3 Drawing Figures

BASE FUZE FOR A SPINNING PROJECTILE

BACKGROUND OF THE INVENTION

The present invention relates to a new and improved construction of base fuze or base percussion fuze for spinning projectiles, which is of the type comprising a firing or ignition pin for piercing a detonator cap, a hammer sleeve secured to the firing pin, and a self-destruction spring under the action of which the hammer sleeve together with the firing pin can be displaced towards or against the detonator cap.

There is already known to the art an impact fuze of this general type wherein a relatively large hammer sleeve is displaceably arranged within a cylindrical bore. The hammer sleeve is provided at its front end with a firing or ignition pin which must be pushed or displaced with a certain speed against a detonator cap to insure reliable response of the latter.

The state-of-the-art impact fuze requires a relatively large self-destruction spring which is capable of accelerating the mass of the hammer sleeve to such a degree that the detonator cap is pierced at the required speed. In the event that the projectile impacts against the target at a small angle of, for instance, less than 5° and is subsequently deflected, then inertia forces directed perpendicular to the fuze axis act upon the hammer sleeve and the self-destruction spring. The hammer sleeve and the self-destruction spring are biased against their guide and the thus resulting frictional forces prevent displacement of the hammer sleeve. The firing pin then impacts with too small velocity or speed against the detonator cap, with the result that there is no longer positively insured for detonation or firing of the detonator cap.

In order to avoid this difficulty the mass of the hammer sleeve must be as large as possible upon impact, in order to be able to overcome the frictional forces, whereas, on the other hand, during self-destruction the mass of the hammer sleeve should be small to insure that the self-destruction spring need not accelerate any large mass.

SUMMARY OF THE INVENTION

Hence, it is a primary object of the present invention to provide an improved construction of impact fuze which fulfills both of these basically contradictory requirements.

A further object of the present invention resides in a new and improved construction of base fuze for a projectile which is relatively simple in construction and design, economical to manufacture, and extremely reliable in operation.

Still another object of this invention relates to a novel construction of impact fuse incorporating means for increasing the mass of the hammer sleeve during piercing of the detonator cap by the firing pin in order to insure for positive detonation of the detonator cap and explosion of the projectile upon hitting the target.

Now in order to implement these and still further objects of the invention, which will become more readily apparent as the description proceeds, the base fuze or impact fuze of this development is manifested by the features that there is provided an inertia body for increasing the response sensitivity of the fuze, this inertia body is located behind the hammer sleeve and upon impact of the projectile bears directly with its front end face at the rear end face of the hammer sleeve in order to increase the mass of the hammer sleeve upon puncturing or piercing the detonator cap by means of the firing pin due to the inertia of the inertia body.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
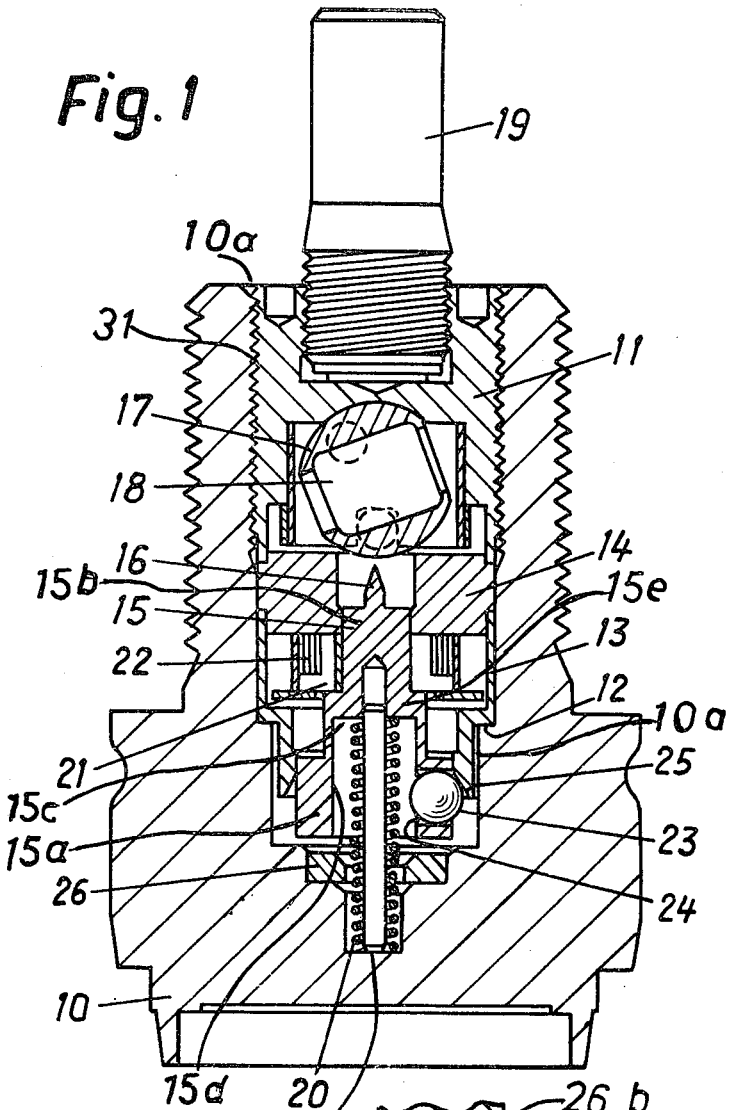
FIG. 1 is a longitudinal sectional view through a first exemplary embodiment of an impact or base fuze constructed according to the invention and illustrated in its unarmed or safety position.

Describing now the drawings, it is to be understood that there are shown therein sufficient details of the various embodiments of impact or base fuzes constructed in accordance with the teachings of the present invention, whereas as a matter of simplification and clarity of illustration the projectile has not been particularly shown inasmuch as the same is conventional in the art. Turning attention to the embodiment of impact or base fuze as shown in FIG. 1 it is to be understood that the same comprises a fuze housing 10 adapted to be threadably connected into a conventional and thus not particularly shown projectile body of a spinning projectile. There is threaded by means of threading 31 provided at a bore 10*a* and a bearing body 11 such bearing body into the aforementioned bore of the fuze housing 10. This bore 10*a* possesses a shoulder 12 against which bears a guide sleeve 13. Seated upon the guide sleeve 13 is a guide disk or plate 14 which is pressed by means of the bearing body 11 against the guide sleeve 13, so that the aforementioned components or parts are fixed within the fuze housing 10. A hammer sleeve 15 or equivalent structure is displaceably guided by means of its lower portion 15*a* in the guide sleeve 13 and with its upper portion 15*b* in the guide disk 14. At the upper portion 15*b* of the hammer sleeve 15 there is integrated or secured a firing or ignition pin 16 or equivalent structure. In the bearing body 11 there is arranged a substantially spherical-shaped rotor 17 which contains a detonator cap 18 or the like and which can be rotated by virtue of the spin of the spinning projectile out of the illustrated safety or unarmed position into the armed position. Furthermore, there is secured a reinforcement charge 19 at the bearing body 11, this reinforcement charge protruding into the not particularly illustrated standard explosive charge of the projectile body. A self-destruction spring 20 bears at one end at the floor or base 10*b* of the fuze housing 10 and at the other end against the floor 15*c* of a bore or recess 15*d* of the hammer sleeve 15. This spring 20 strives to displace the hammer sleeve 15 together with the firing pin 16 against the detonator cap 18. This displacement is hindered by a number of locking bodies 21 which bear at one end at the guide disk or plate 14 and at the other end at a shoulder 15*e* of the hammer sleeve 15. The substantially segment-shaped locking or blocking bodies 21 are held together by means of a small centrifugal band 22 composed, for instance, of a thin metallic foil and wound about the locking bodies 21. Furthermore, the displacement of the hammer sleeve 15 is prevented by means of substantially spherical-shaped centrifugal bodies 23 defining centrifugal locking means located in radial bores 24 of the hammer sleeve 15 and under the action of the projectile spin bear against a substantially conical surface 25 provided at the inside of the guide sleeve 13. Rearwardly or behind the hammer sleeve 15 there is displaceably arranged an inertia body or inertia means 26 within the fuze housing 10.

Figure 2:
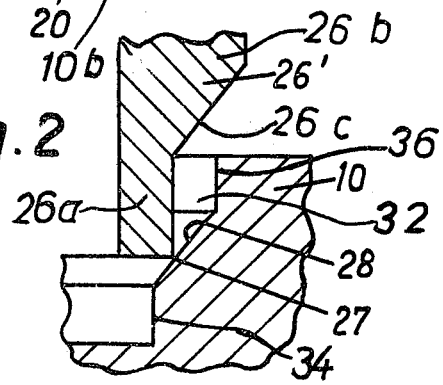
FIG. 2 illustrates on an enlarged scale a detail of an impact or base fuze according to a second exemplary embodiment and shown in the armed position.

The impact or base fuze of the modified arrangement of FIG. 2 differs from the impact fuze illustrated in FIG. 1 only with respect to the form or shape of the inertia body 26'. The inertia body 26' according to this second exemplary embodiment possesses two substantially cylindrical portions 26*a* and 26*b* of different diameter which are interconnected with one another by a forwardly widening or tapering conical portion 26*c*. The bore 32 within which there is located the inertia body 26' likewise possesses two substantially cylindrical portions 34 and 36 of different diameter and which are interconnected with one another by a forwardly widening or tapering substantially conical surface 28.

The inertia body 26' of the embodiment of FIG. 2 is dimensioned such that during its displacement towards the front it can slide by means of its rearmost edge 27 upon the conical surface 28. Further details of the impact or base fuze of the arrangement of FIG. 2 will be apparent from the showing of FIG. 3 wherein the fuze thereof only possesses a different construction of inertia body 26'' as will be more fully explained hereinafter. By way of completeness it is mentioned that throughout the various embodiments generally the same or analogous components have been designated, whenever convenient, with the same reference characters.

Figure 3:
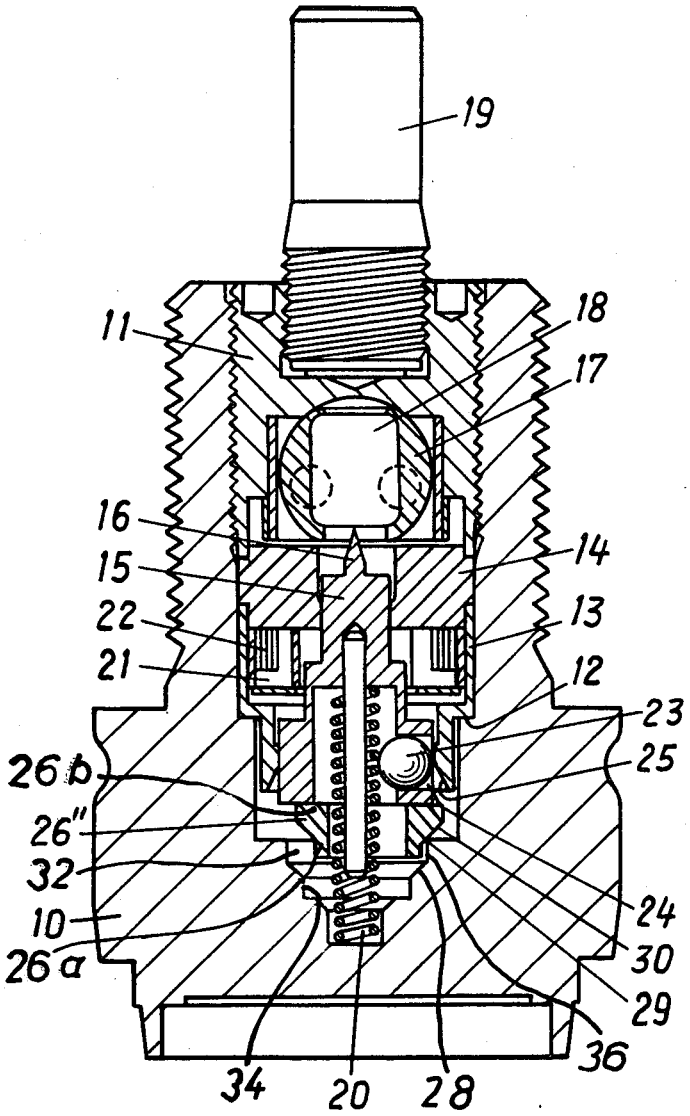
FIG. 3 is a longitudinal sectional view through the same impact of base fuze as shown in FIG. 2, and illustrated in the armed position but with a different construction of inertia body.

Continuing, in contrast to the arrangement of FIG. 2, in the impact or base fuze shown in FIG. 3 the inertia body or inertia means 26'' is dimensioned such that during its displacement towards the front it can slide by means of its conical surface 30 upon an edge 29 of the bore 32.

Having now had the benefit of the discussion of the various exemplary embodiments of impact or base fuze of this development, the mode of operation will be considered and is as follows:

Upon firing the not particularly illustrated projectile the rotor 17 is rotated out of the position of FIG. 1 into the position of FIG. 3 due to the spin of the projectile. Consequently, the firing or ignition pin 16 is in a position where it can pierce or puncture the detonator cap 18. Further, owing to the projectile spin the centrifugal band 22 is unwound from the position shown in FIG. 1 into the position shown in FIG. 3, whereby, also the locking or blocking bodies 21 are shifted out of their locking position into the release position. The hammer sleeve 15 is then only still held by the centrifugal bodies or body means 23 which, under the action of the projectile spin, bear against the substantially conical surface 25 of the guide sleeve 13, and thus prevent puncture or piercing of the detonator cap 18 by the firing pin 16.

In the event that the projectile hits the target at a very small angle of, for instance, 3° to 5° and is subsequently deflected, inertia forces directed also perpendicular to the fuze axis act upon the hammer sleeve 15 and the self-destruction spring 20. Hence, there then act upon the hammer sleeve 15 and the self-destruction spring 20 frictional forces by means of which there is prevented the displacement of the hammer sleeve 15 by the self-destruction spring 20. Under certain circumstances it is possible for the displacement to then occur so slowly that the ignition of the detonator cap 18 by means of the firing pin 16 is no longer insured. However, this danger is beneficially avoided by virtue of the arrangement of the inertia body or inertia body means 26 or 26' or 26'', as the case may be.

Upon impact of the projectile the inertia body 26 or 26' or 26'' and the hammer sleeve 15 are forwardly accelerated by virtue of their inertia forces. The inertia body 26 or 26' or 26'' thus drives the hammer sleeve 15, so that the firing or ignition pin 16 secured to the hammer sleeve 15 impinges against the detonator cap 18 with the required velocity.

It is advantageous if the inertia body 26 26' or 26'' is not formed of a single piece i.e. integrally with the hammer sleeve 15. During the self-destruction the hammer sleeve 15 is exclusively accelerated by the self-destruction spring 20. In this case the mass of the hammer sleeve 15 should be as small as possible. If the hammer sleeve 15 and the inertia body 26 or 26' or 26'' were formed of one piece, then the self-destruction spring 20 would have to accelerate much too large a mass, so that it is conceivably possible in certain instances there is not attained the speed or velocity needed for igniting the detonator cap by means of the firing pin.

As soon as in the case of grazing or glancing shots the inertia body or inertia body means 26' or 26'' of the arrangements of FIGS. 2 and 3 have shifted somewhat upon impact of the projectile, the inertia body 26', under the action of the inertia force effective perpendicular to the fuze axis, slides by means of its edge 27 upon the substantially conical surface 28 of the bore 32, or the edge 29 of the bore 32 slides upon the substantially conical surface 30 of the inertia body 26'' towards the outside and forwardly and displaces the hammer sleeve 15 with the firing pin 16 against the detonator cap 18.

Due to the cylindrical guiding of the inertia body 26 or 26' or 26'' there is avoided the danger that the projectile will be detonated or exploded directly after exit from the barrel of the weapon.

After the departure of the projectile out of the weapon barrel, when acceleration forces no longer act upon the projectile and thus upon the inertia body 26, or 26' or 26'' there is present the danger that with eccentric position of the center of gravity of the inertia body in the absence of any cylindrical guiding the inertia body will shift or displace transversely with respect to the projectile axis under the effect of the centrifugal force, and thus the hammer sleeve 15 will be displaced forwardly, with the result that there could occur a premature destruction or explosion of the projectile.

While there is shown and described present preferred embodiments of the invention, it is to be distinctly understood that the invention is not limited thereto, but may be otherwise variously embodied and practiced within the scope of the following claims. Accordingly,

What is claimed is:

1. A base fuze for a spinning projectile, comprising a fuze housing provided with bore means, a detonator cap, means for mounting said detonator cap in said bore means, a firing pin for piercing said detonator cap, a hammer sleeve with which there is attached said firing pin, centrifugal locking means for holding the hammer sleeve in a rest position spaced from the detonator cap, a self-destruction spring for displacing the hammer sleeve together with the firing pin towards the detonator cap, an inertia body for increasing the response sensitivity of the fuze, said inertia body being located behind said hammer sleeve, said inertia body having a front end face defining a front contact surface, said hammer sleeve having a rear end face defining a rear contact surface, said front contact surface and said rear contact surface confronting one another, said inertia body bearing with its front contact surface directly against the rear contact surface of said hammer sleeve upon impact of the projectile in order to increase the mass of the hammer sleeve during piercing of the detonator cap by the firing pin owing to the inertia of the inertia body.

2. The fuze as defined in claim 1, wherein the inertia body possesses two substantially cylindrical portions of different diameter which are interconnected with one another by means of a forwardly widening substantially conical surface means.

3. The fuze as defined in claim 1, wherein the inertia body is arranged in the bore means of the fuze housing, said bore means including a bore portion possessing two substantially cylindrical portions of different diameter which are interconnected with one another by means of a forwardly widening substantially conical surface means.

4. The fuze as defined in claim 1, wherein said front contact surface and said rear contact surface directly bear against one another at a location removed from and out of contact with said centrifugal locking means.

5. A base fuze for a spinning projectile comprising a detonator cap, a firing pin for piercing said detonator cap, hammer means at which there is carried said firing pin, spring means for displacing the hammer means together with the firing pin towards the detonator cap, centrifugal locking means for holding the hammer means in a rest position spaced from the detonator cap, inertia body means located adjacent said hammer means, said inertia body means having a front end face defining a front contact surface, said hammer means having a rear end face defining a rear contact surface, said front contact surface and said rear contact surface confronting one another, said inertia body means bearing with said front contact surface at said rear contact surface of said hammer means upon impact of the projectile in order to increase the mass of the hammer means during piercing of the detonator cap by the firing pin owing to the inertia of the inertia body means.

* * * * *